United States Patent [19]

Gratzl

[11] Patent Number: 4,826,568

[45] **Date of Patent: * May 2, 1989**

[54] PROCESS FOR DELIGNIFICATION OF CELLULOSIC SUBSTANCES BY PRETREATING WITH A COMPLEXING AGENT FOLLOWED BY PEROXIDE PRIOR TO KRAFT DIGESTION

[75] Inventor: Josef S. Gratzl, Cary, N.C.

[73] Assignee: Interox (Société Anonyme), Brussels, Belgium

[ * ] Notice: The portion of the term of this patent subsequent to May 2, 2006 has been disclaimed.

[21] Appl. No.: 20,232

[22] Filed: Mar. 2, 1987

Related U.S. Application Data

[63] Continuation of Ser. No. 762,724, Aug. 5, 1985, abandoned.

[51] Int. Cl.[4] ..... D21C 1/04; D21C 1/08; D21C 3/02

[52] U.S. Cl. ..... 162/76; 162/78; 162/82

[58] Field of Search ..... 162/65, 19, 84, 60, 162/78, 90, 76

[56] References Cited

U.S. PATENT DOCUMENTS

| | | | |
|---|---|---|---|
| 4,050,981 | 9/1977 | Jamieson et al. | 162/65 |
| 4,462,864 | 7/1984 | Carles | 162/78 |

FOREIGN PATENT DOCUMENTS

| | | | |
|---|---|---|---|
| 678022 | 5/1966 | Belgium . | |
| 873649 | 4/1953 | Fed. Rep. of Germany . | |
| 58-91884 | of 1983 | Japan | 162/78 |
| 8091884 | 5/1983 | Japan | 162/78 |

OTHER PUBLICATIONS

EUCEPA Symposium "The Delignification Methods of the Future", vol. II, No. 7–18 Helsinki, Jun. 2–5 1980 (Pekkala p. 14/1 to 14/19).

Przeglad Papierniczy, vol. 33, Aug. 1977, W. Mroz and W. Surewicz, "Modification of the Kraft Pulping Process aimed at Improving the Color of the Pulp" (pp. 277 to 280).

*Primary Examiner*—Steve Alvo

*Attorney, Agent, or Firm*—Spencer & Frank

[57] ABSTRACT

Process for the delignification of cellulosic substances comprising:

a first stage of treatment of cellulosic substances with an acid a second stage of treatment with hydrogen peroxide in an alkaline medium a third stage of digestion in the presence of at least one chemical reactant chosen from sulphur-containing compounds and oxygen.

The process applies to the treatment of wood fragments.

1 Claim, No Drawings

PROCESS FOR DELIGNIFICATION OF CELLULOSIC SUBSTANCES BY PRETREATING WITH A COMPLEXING AGENT FOLLOWED BY PEROXIDE PRIOR TO KRAFT DIGESTION

CROSS REFERENCE TO RELATED APPLICATION

The present application is a continuation of Application Ser. No. 06/762,724, filed Aug. 5th, 1985, and now abandoned, the entire specification of which is incorporated herein by reference.

The present invention relates to a process for the delignification of lignocellulosic substances with a view to the preparation of pulps intended for paper manufacture. It relates more specifically to the field of chemical pulps produced by digesting cellulosic substances in the presence of chemical reactants endowed with delignifying properties.

Attempts have been made for a long time to increase the efficiency of the digestion of cellulosic substances by subjecting the latter, before the digestion, to an impregnation with a solution containing a peroxide compound.

In Patent No. DE-B-873,649 (Degussa), it is disclosed that pretreatment of cellulosic substances by means of an aqueous solution of a peroxide compound, before their digestion using a sulphite or bisulphite process, improves the whiteness of the pulp produced. This pretreatment also makes it possible, for an equivalent pulp whiteness, to carry out the digestion under conditions which are milder for the cellulose, namely at reduced temperature or for a shorter period (page 2, lines 51 to 59).

Belgian patent No. BE-A-678,022 (Degussa) relates to a similar process in which the pretreatment of the cellulosic substances with the aqueous solution of the peroxide compound is carried out in a strongly alkaline medium. This patent teaches that, when this technique is applied, the subsequent chemical digestion process is facilitated, while the weight yield of pulp is maintained (page 3, last paragraph and page 4, lines 1 to 13).

In Przeglad Papierniczy, vol. 3, August 1977, W. Mroz and W. Surewicz, "Modification of the kraft pulping process aimed at improving the color of the pulp" (page 277 to 280) it is noted that, in the case of a kraft-type alkaline digestion, a pretreatment of the cellulosic substances with a peroxide compound improves whiteness of the pulp only slightly, and it is demonstrated therein that better results are produced by an impregnation pretreatment by means of reducing agents, in particular hydrazine, rather than by means of oxidizing agents.

However, all these known processes have the disadvantage of producing pulps which are more degraded, that is to say with lower viscosity, and the weight yield of which is generally lower, compared to the viscosities and to the yields of the conventional chemical pulps with an equivalent degree of delignification.

The invention overcomes these disadvantages of the known processes, by providing a new process for the delignification of cellulosic substances, which makes it possible to attain high degrees of delignification while retaining the intrinsic quality of the cellulose and the weight yield of pulp produced.

To this end, the invention relates to a process for the delignification of cellulosic substances according to which, in a first stage, cellulosic substances are treated with an acid, in a second stage the cellulosic substances from the first stage are treated with hydrogen peroxide in an alkaline medium and, in a third stage, the cellulosic substances from the second stage are subjected to a digestion in the presence of at least one chemical reactant chosen from sulphur-containing compounds and oxygen.

According to the invention, the term "cellulosic substances" is intended to refer to fragments of ligneceous plants employed as raw materials in the paper-making industry. Examples of such materials are fragments of wood, of annula herbaceous plants such as alfa-alfa, of plants of the class of monocotyledons such as the straws of cereals, bamboo, esparto, rushes and reeds, as well as sugar cane, in particular its residue, bagasse, after sugar has been extracted. The invention applies more particularly to wood fragments. All types of resinous woods (softwoods) or deciduous woods (hardwoods) which can be employed in the papermaking industry are suitable for the process according to the invention. Resinous wood chips and sawmill wastes are particularly suitable.

In the process according to the invention, the treatment with an acid is intended to decontaminate the cellulosic substances from the metals which they generally contain. Any inorganic or organic acids employed in aqueous solution, alone or in a mixture, are suitable. Strong inorganic acids such as sulphuric acid or hydrochloric acid are suitable. It is suitable that the first stage be carried out in the presence of a complexing agent for metal ions. To this end, mixtures of the aforesaid strong inorganic acids with organic acids from the group of aminopolycarboxylic or aminopolyphosphonic acids or their salts of alkaline metals, which have sequestering properties in respect of metal ions, are particularly suitable. Diethylenetriaminepentaacetic acid (DTPA) is preferred. Examples of suitable aminopolycarboxylic acids are diethylenetriaminepentaacetic acid, ethylenediaminetetraacetic acid, cyclohexanediaminetetraacetic acid and nitrilotriacetic acid. Examples of aminopolyphosphonic acids are diethylenetriaminepentamethylenephosphonic acid, ethylenediaminetetra(methylenephosphonic) acid and nitrolotri(methylenephosphonic acid. Diethylenetriaminepentamethylenephosphonic acid (DTMPA) is preferred.

The operating conditions in the first stage of the process according to the invention are not critical. They should be determined in each individual case as a function of the type of cellulosic substances and of the equipment in which the treatment is being carried out. In general, the choice of the acid and the quantity employed should be fixed so that the medium is at a pH below 7, for example between 0.5 and 6.5; pH values which are particularly advantageous are those between 1.0 and 4.0.

The temperature and pressure are not critical, ambient temperature and atmospheric pressure being generally suitable. The length of the treatment may vary within wide limits depending on the type of equipment employed, the choice of acid, the temperature and the pressure, for example from 30 minutes to several hours when the treatment is carried out by soaking the cellulosic substances in a chest, and from 1 to 120 minutes when it is carried out by percolation in a column in which the cellulosic substances to be treated are stacked.

In an alternative embodiment of the process according to the invention, the cellulosic substances may be subjected to a steam treatment before the first stage. The aim of this treatment is to facilitate the impregnation operations which will follow.

The role of the hydrogen peroxide employed in the second stage of the process according to the invention is to accelerate the delignification of the cellulosic substances and to retard carbohydrate degradation in the digestion stage which follows. The optimum quantity of hydrogen peroxide to be employed depends on the source of the cellulosic substances. In general, more than 0.1 g of hydrogen peroxide must be employed per 100 g of dry cellulosic substance. Quantities of hydrogen peroxide which are greater than 3 g/100 g of dry cellulosic substance are seldom necessary to produce rapid delignificaion. Usually, use is made of hydrogen peroxide proportions of between 0.5 and 2 g/100 g of dry substance. Peroxide proportions of between 0.7 and 1.5 g/100 g of dry substance have given the best results.

The hydrogen peroxide employed may be anhydrous hydrogen peroxide or, preferably, an aqueous solution, for example a commercial aqueous solution of hydrogen peroxide the weight concentration of which is between 25 and 90 g of pure hydrogen peroxide per 100 g of solution or an aqueous diluted alkaline solution of hydrogen peroxide obtained by electrochemical reduction of oxygen.

In the process according to the invention, the treatment of cellulosic substances with alkaline hydrogen peroxide may be carried out in the presence of additives such as, for example, stabilizers and inhibitors of the decomposition of hydrogen peroxide. Such additives are, for example, inorganic or organic sequestering agents for metal ions, such as magnesium salts, aminopolycarboxylic acids or sodium silicate of water glass quality. Other additives which can also be employed are surface-active agents, wetting agents, agents capable of protecting the cellulose chains to prevent their depolymerisation, activating agents or anticorrosion agents. The quantity of additive introduced is generally never greater than 1% of the weight of cellulosic substances. In most cases it is between 0 and 0.5% of the weight of these substances.

In the second stage of the process according to the invention, the alkaline medium is produced by the addition of soluble substances of a basic nature. Ammonia, inorganic carbonates and hydroxides of alkali or alkaline-earth metals, such as sodium, potassium or calcium carbonate, and sodium, potassium or calcium hydroxide are generally employed. Alkali or alkaline-earth metal oxides or peroxides, such as $Na_2O$, $Na_2O_2$, CaO and $CaO_2$, may also be suitable and, in the case of the peroxides, may replace the addition of a part of the hydrogen peroxide introduced in the second stage of the process. Sodium hydroxide is usually preferred on account of its ready availability and its low cost. The quantities of basic substance to be employed are chosen so as to adjust the pH of the peroxide solution between 11 and 13.5, and preferably between 12 and 13.

The operating conditions for the second stage of the process according to the invention may also vary within fairly wide limits depending, particularly, on the type of cellulosic substances and the type of equipment employed. The pressure prevailing during the second stage may thus be in the range from 2 kPa to 10 Mpa, and the temperature in the range from 290 K. to 380 K. The treatment with hydrogen peroxide in an alkaline medium in the second stage is generally carried out for a time longer than 2 minutes and not exceeding 180 minutes.

In a particular embodiment of the invention, the cellulosic substances to be treated are subjected to alkaline hydrogen peroxide in a liquor to wood weight ratio not exceeding 2.5:1, preferably ranging from 1:1 to 2:1. In this preferred embodiment, the cellulosic substances originating from the first stage are impregnated in a closed reactor with the preheated alkaline hydrogen peroxide liquor, and then the excess liquor which has not impregnated the cellulosic substances is drained from the reactor which is then heated to reaction temperature.

In this preferred embodiment, soaking of the cellulosic substances in hydrogen peroxide liquor, before the reaction, generally requires not more than 5 minutes. However, it cannot usually be carried out in less than 30 seconds. The temperature of the peroxide liquor is in most cases chosen 5 to 20 K. higher than that prevailing in the reactor, which is maintained for 15 to 120 minutes by means of the heating jacket. A reaction temperature of between 310 and 360 K. is suitable. The best results have been obtained at a temperature of 323 K. and with a reaction time of 45 minutes.

The third stage of the process according to the invention consists in subjecting the cellulosic substances originating from the second stage to an alkaline digestion in the presence of at least one chemical reactant. The term "chemical reactants" should be understood to mean the acidic or alkaline sulphur-containing materials such as those employed in the well-known digestions in the paper pulp industry under the name of digestions with sodium or magnesium sulphite, with sodium, magnesium or calcium bisulphite, with sodium, magnesium or calcium hydrogen sulphite, and with sodium sulphate, or kraft digestion. Oxygen digestions are also included in the category of the digestions by means of chemical reactants.

The optimum operating conditions for the third stage of the process according to the invention depend on various parameters, particularly on the source of the cellulosic substances and they may be readily determined in each individual case.

In a preferred embodiment of the process according to the invention, washing of the cellulosic substances with water is carried out between the second and the third stage. Said embodiment is advantageous when the third stage is carried out with the use of sulphur-containing reactants. This washing is intended to eliminate from the cellulosic substances at least a part of the water-soluble materials produced during the second stage, and to extract the last traces of hydrogen peroxide which are still present, to avoid unnecessary oxidation of the sulphur-containing reactants employed in the third, digestion, stage.

The process according to the invention makes it possible to accelerate markedly the delignification of the cellulosic substances which are treated, resulting in a shortening of the time required for the third stage of digestion with chemical reactants. This results in the major advantage of an appreciable reduction in the size of the digestion equipment, resulting in savings of space and lower capital cost or, alternatively of an increased throughput with a given digestion equipment.

The invention also permits, at an equal degree of delignfication, an appreciable reduction in the quantity of the chemical reactants in the digestion stage. This leads to a substantial saving in chemical reactants and reduces environmental pollution, particularly by gaseous and liquid sulphur-containing wastes in the case where sulphur-containing chemical reactants are employed.

Finally, the invention also produces, in better weight yields and consequently at a lower cost, chemical pulps with higher viscosities than those produced by the processes of the prior art.

The examples of practical embodiment which follow are intended to illustrate the invention without, however, restricting its scope.

First series of tests (tests 1 to 6R)

Tests 1 to 6R, the description of which follows, are intended to demonstrate the benefit contributed by the invention to the performance of the method of chemical digestion of cellulosic substances.

Test 1 (according to the invention)

Loblolly pine (Pinus taeda) wood meal (particle size fraction passing a 40-mesh sieve and retained on a 60-mesh Tyler standard sieve) was subjected to a hydrochloric acid treatment carried out by soaking the wood meal in a 0.1M HCl solution for 4 hours at ambient temperature. The aqueous solution was used in a quantity by weight equal to 40 times the weight of the treated wood meal (First stage). Wood meal originating from the first stage, in a quantity equivalent to 10 g of dry substance, was introduced into a 200-ml reactor lined internally with a coating of polytetrafluoroethylene. After preheating of the reactor to 323 K. in a polyethylene glycol bath, 150 g of an aqueous solution of 0.4M of hydrogen peroxide and 0.5M in sodium hydroxide and 0.001M in $Mg^{++}$ was introduced into the reactor. The reactor was then heated to 353 K. in 30 minutes, and then maintained for 15 minutes at this last temperature. The reactor was then cooled and the wood meal was washed (Second stage).

The wood meal originating from the second stage was then subjected to a kraft digestion in the presence of an aqueous $Na_2S$ and NaOH liquor in a stainless steel laboratory autoclave 450 ml in capacity, fitted with a stirrer (Third stage). The operating conditions for this digestion were as follows:

Active alkali in the liquor: 20 g $Na_2O$/liter of liquor
Sulphidity of the liquor: 25%
Liquor/dry wood meal weight ratio: 40:1
Temperature and duration: 90 minutes of heating from ambient temperature to 443 K. and holding at 443 K. for 52.5 minutes Test 2R (reference)

The conditions in this reference test were identical to those in test 1, except that the first stage of the treatment was nos carried out.

Test 3R (reference)

Identical to test 1, except for the second stage of treatment, which was not carried out.

Tests 4R to 6R (reference)

These are conventional kraft digestions. Setting aside stages 1 and 2, which were not carried out, the operating conditions were the same as in test 1. In tests 5R and 6R, however, the time of the digestion at 443 K. was increased to 60 and 75 minutes respectively.

At the end of the digestion stage the pulp produced was analysed from three points of view: kappa number, total weight yield and viscosity. The methods employed for these analyses were the following standard methods:
kappa number: TAPPI standard T236
viscosity: TAPPI standard T230

The results obtained are shown in Table I.

TABLE I

| | Operating conditions | | | | Characteristics of the pulp produced | | |
|---|---|---|---|---|---|---|---|
| Test No. | 1st stage HCl | 2nd stage $H_2O_2$ | 3rd stage kraft digestion | Length of the 3rd stage min. | Kappa no. | Total yield (weight %) | Viscosity (mPa s) |
| 1 | yes | yes | yes | 52.5 | 34.5 | 46.1 | 19.4 |
| 2R | no | yes | yes | 52.5 | 28.3 | 41.5 | 9.4 |
| 3R | yes | no | yes | 52.5 | 53.8 | 48.4 | 22.1 |
| 4R | no | no | yes | 52.5 | 54.4 | 48.1 | 18.6 |
| 5R | no | no | yes | 60 | 45.2 | 46.9 | 16.4 |
| 6R | no | no | yes | 75 | 30.5 | 45.3 | 15.1 |

A comparison of the results of test 1 with those of tests 2R, 3R and 4R shows the unexpected synergistic effect of the combined use of the first and second stages of the invention on the pulp viscosity at the end of the subsequent digestion stage. It can also be seen, furthermore, that the sequential use of the two first stages of the process according to the invention has also made it possible, in a wholly surprising manner, to eliminate the severe drop in pulp viscosity due to the action of the oxidizing agent; comparison of test 1 with test 4R even shows an improvement in the viscosity of the pulp produced according to the process of the invention.

Tests 5R and 6R were carried out for reference to evaluate the weight yield and the viscosity of the pulps delignified by means of the digestion stage alone (in accordance with the process of the prior art), for a degree of delignification (measured by the kappa number) equivalent to that produced in test 1. The advantage conferred by the invention can be seen directly insofar as the time of chemical digestion is concerned. It also appears that the process according to the invention provides pulps of better viscosity and higher weight yield.

Second series of tests (tests 7 to 11R)

Tests 7 to 11R, the description of which follows, are also intended to demonstrate the effect of the invention on the performance of the method of chemical digestion of cellulosic substances.

Test 7 (according to the invention)

In these tests, 300 g of loblolly pine (Pinus taeda) wood chips were introduced into a jacketed glass reactor fitted with a fluidtight cover. The cover has two openings: the first is connected to a vacuum take-off and the second permits a tubular probe to enter down to the bottom of the reactor. This probe is connected to a reactant stocktank, the latter communicating with the atmosphere or with a vacuum pump via a three-way valve.

The chips were then immersed, at ambient temperature, in an aqueous solution 0.003M in $Na_5DTPA$ and 0.1N in $H_2SO_4$ by drawing the solution into the reactor by means of the reduced pressure produced by the vacuum pipework. A weight of aqueous solution equal to 8 times the weight of dry wood was employed. After 4 hours' impregnation, three washing cycles, each of 2 hours, were carried out with a wash bath weight equal to 8 times the weight of dry wood (First stage).

An aqueous solution 0.3M in $H_2O_2$, 0.5M in NaOH and 0.001M in $Mg^{++}$ ions preheated to 323 K., was then introduced into the reactor; the solution was employed in a quantity by weight equal to 6 times the weight of dry wood. After two minutes' impregnation, the excess liquor was drawn out of the reaction by means of the tubular probe. The reaction was then allowed to take place in the vapour phase for 45 minutes by heating the reactor by circulating water thermostated at 323 K. through the jacket (Second stage).

The chips originating from the second stage were then subjected to a conventional kraft digestion in liquid phase in a stainless steel reactor, the heat input being produced by placing the reactor in a hot air environment produced by an oven. The operating conditions of the kraft digestion were:

Total active alkali in the liquor: 20% expressed as $Na_2O$
Sulphidity of the liquor: 25%
Liquor/dry wood weight ratio 5:1
Temperature and duration: 90 minutes of heating up to 443 K., followed by 45 minutes at 443 K.

Test 8R (reference)

Conditions identical to test 7, except for the first stage of treatment, which was not carried out.

Test 9R (reference)

Identical to test 7, except that the second stage of treatment with hydrogen peroxide was not carried out.

Test 10R and 11R (reference)

In these tests only the third stage of the conventional kraft digestion was carried out under the same conditions as the third stage in test 7. In the case of test 11R, however, the proportion of active alkali was increased up to 26% of $Na_2O$.

The pulp produced at the end of the digestion stage was analysed from the same point of view and using the same methods as in tests 1 to 6R except where viscosity is concerned.

The results are shown in Table II.

TABLE II

| | Operating conditions | | | | Characteristics of the pulp produced | |
|---|---|---|---|---|---|---|
| Test No. | 1st stage DTPA | 2nd stage $H_2O_2$ | 3rd stage kraft digestion | Active alkali content in the 3rd stage % | Kappa no. | Total yield (weight %) |
| 7 | yes | yes | yes | 20 | 34.9 | 46.4 |
| 8R | no | yes | yes | 20 | 42.9 | 45.0 |
| 9R | yes | no | yes | 20 | 52.2 | 48.2 |
| 10R | no | no | yes | 20 | 60.3 | 50.2 |
| 11R | no | no | yes | 26 | 34.3 | 45.5 |

Comparison of the results of test 7, carried out according to the process of the invention, with test 11R shows that at an equivalent degree of delignification the process according to the invention provides, after digestion, a kraft pulp in a higher weight yield.

Tests 7, 8R, 9R and 10R also show, as in the first series of tests, that the combination of the first two stages produces an unexpected synergistic effect in the process according to the invention.

Third series of tests (tests 12 and 13)

Tests 12 and 13, both in accordance with the invention, are intended to demonstrate the advantage conferred by the particular embodiment of the invention which consists in interposing a water-washing of the cellulosic substances between the second and the third stages of the process.

First and second stages of the process were identical to those performed in the second series of tests hereabove described.

In test 12 the third stage of the process is then carried out directly, while in test 13 three washing cycles are first carried out with hot water, each lasting for 2 hours, the quantity by weight of the water employed being equal to 8 times the weight of dry wood.

In the third stage the impregnation with the kraft digestion liquor is carried out so as to produce the following operaing conditions:

Active alkali: 20% expressed as $Na_2O$
Sulphidity: 25%
Liquor/dry wood weight ratio: 5:1
Temperature and duration: 80 minutes' heating up to 443 K., following by 30 minutes' holding at 443 K.

After digestion, the pulp produced was analysed as in the first series of Examples. The results are given in Table III.

TABLE III

| | Operating conditions | | | | Characteristics of the pulp produced | | |
|---|---|---|---|---|---|---|---|
| Test No. | 1st stage DTPA | 2nd stage $H_2O_2$ | Inter-mediate wash | 3rd stage kraft digestion | Kappa no. | Total yield (weight %) | Viscosity (mPa s) |
| 12 | yes | yes | no | yes | 47.1 | 47.6 | 45.8 |
| 13 | yes | yes | yes | yes | 43.1 | 47.9 | 47.6 |

These results highlight the benefit of the intermediate washing operating between the second and the third stages of the process according to the invention.

They illustrate its beneficial effect on the increase in the degree of delignification while maintaining more effectively the weight yield and the viscosity of the pulp produced.

Fourth series of tests (tests 14 to 16)

The purpose of tests 14 to 16 in accordance with the invention was to illustrate the effect of the pH during the hydrogen peroxide treatment in the second stage of the process according to the invention. These tests were carried out on loblolly pine (Pinus taeda) wood meal under the same operating conditions as in the first series of tests except for the quantities of NaOH in the second stage which were adjusted to vary the pH in this stage in the range from 10.1 to 12.9 at the start of reaction.

The results are shown in Table V.

TABLE V

| | Operating conditions | | | | Characteristics of the pulp produced | |
|---|---|---|---|---|---|---|
| Test No. | 1st stage acid | 2nd stage $H_2O_2$ | Initial pH of the 2nd stage | 3rd stage kraft digestion | Kappa no. | Total yield (weight %) |
| 14 | yes | yes | 10.1 | yes | 44.8 | 46.9 |
| 15 | yes | yes | 11.8 | yes | 38.2 | 46.7 |
| 16 | yes | yes | 12.9 | yes | 35.5 | 46.2 |

The most advantageous kappa number was that in test 16, where the pH is between 12 and 13 in the second stage. The increase in pH has no marked effect on the drop in yield.

I claim:

1. Process for the delignification of lignocellulosic substances, comprising:

treating a lignocellulosic material in a first stage with an inorganic acid at a pH of between about 1 and about 4, in the presence of diethylenetriaminepentaacetic acid or an alkaline metal salt of diethylenetriaminepentaacetic acid to sequester metal ions, treating said lignocellulosic material in a second stage with a quantity of hydrogen peroxide of between about 0.5 and about 2 grams per 100 grams of dry lignocellulosic material in which the liquor to wood weight ratio is kept between about 1:1 and about 2:1 in an alkaline medium containing sodium hydroxide at an initial pH of between about 12 and about 13 to accelerate delignification of said lignocellulosic material and retard carbohydrate degradation during subsequent digestion, water washing said treated lignocellulosic material of said second stage, and digesting said water washed lignocellulosic material in a kraft digestion to produce a paper pulp.

* * * * *